United States Patent [19]

Williams

[11] Patent Number: 4,524,830

[45] Date of Patent: Jun. 25, 1985

[54] LANDING NIPPLE WITH SUBSURFACE SAFETY VALVE

[75] Inventor: Charles R. Williams, Carrollton, Tex.

[73] Assignee: Otis Engineering Corporation, Carrollton, Tex.

[21] Appl. No.: 511,012

[22] Filed: Jul. 5, 1983

[51] Int. Cl.[3] ..... E21B 34/10; E21B 43/12

[52] U.S. Cl. ..... 166/321; 166/322; 166/242

[58] Field of Search ..... 166/322, 332, 374, 375, 166/319, 321, 242

[56] References Cited

U.S. PATENT DOCUMENTS

| | | | |
|---|---|---|---|
| 3,882,935 | 5/1975 | Calhoun | 166/322 |
| 4,026,362 | 5/1977 | Mott | 166/322 |
| 4,214,606 | 7/1980 | Deaton et al. | 166/322 |
| 4,252,197 | 2/1981 | Pringle | 166/322 |
| 4,294,315 | 10/1981 | Yonker et al. | 166/322 |
| 4,422,618 | 12/1983 | Lawson | 166/332 |
| 4,436,152 | 3/1984 | Fisher, Jr. et al. | 166/214 |
| 4,441,558 | 4/1984 | Welch et al. | 166/322 |

OTHER PUBLICATIONS

Composite Catalog of Oil Field Equipment & Services, 1982–1983, p. 4591.

*Primary Examiner*—Stephen J. Novosad
*Assistant Examiner*—Michael Goodwin
*Attorney, Agent, or Firm*—Vinson & Elkins

[57] ABSTRACT

A cooperating landing nipple and subsurface safety valve in which the closure springs for the subsurface safety valves are carried by the landing nipple and the actuator and the pressure responsive member for effecting opening and closing of the valve are carried by the subsurface safety valve.

6 Claims, 4 Drawing Figures

LANDING NIPPLE WITH SUBSURFACE SAFETY VALVE

Figure 1:
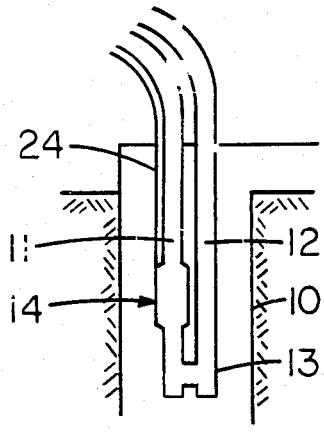

This invention relates to subsurface safety valves and more particularly to a form of subsurface safety valve in which all of the operative components of the valve are retrievable from the well with the exception of the valve closure springs which are carried in the landing nipple.

Subsurface safety valves of the type which are controlled from the surface have been utilized for many years. One of the problems experienced with subsurface safety valves of the type which are removable from the tubing string has been that the flowway through the retrievable valve has been reduced to provide an annular space for the necessary operating components.

It has been suggested that a retrievable subsurface safety valve be used upon failure of a tubing subsurface safety valve in which only the valve member and seat and the valve actuator are retrievable. See *Composite Catalog of Oil Field Equipment and Services,* 1982–1983, page 4591. In the event of failure of any of the seals of the operating piston which cooperates with the retrievable valve, the entire string must be pulled to replace such seals.

An object of this invention is to provide a simple surface controlled subsurface safety valve in which the return springs for the safety valve are carried in the landing nipple to permit a large flowway through the valve and all seals are carried by the retrievable valve member to permit their ready retrieval and replacement in the event of failure.

Another object is to provide a subsurface safety valve as in the preceding object in which spring assemblies may be stacked in tandem to provide sufficient force to offset the weight of the column of control fluid to thus eliminate any need for balancing the weight of the column of control fluid.

Another object is to provide a surface controlled subsurface safety valve in which the return springs are carried in the landing nipple and in which selector keys may be utilized to land and attach the actuator to the spring assembly in only the desired landing nipple.

Other objects, features and advantages of this invention will be apparent from the drawings, the specification and the claims.

Figure 2A:
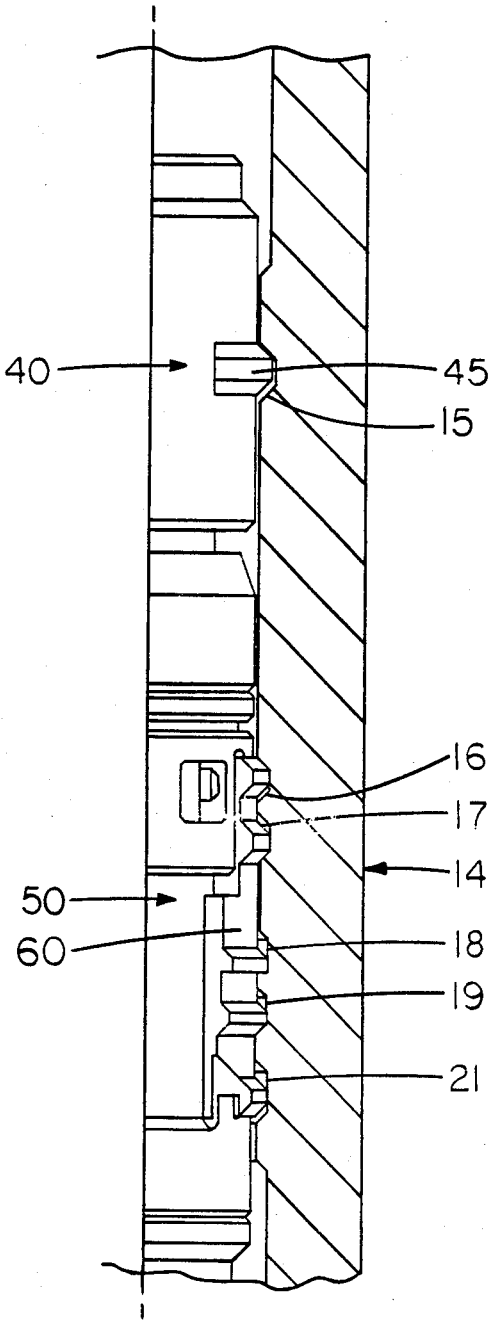
Figure 2B:
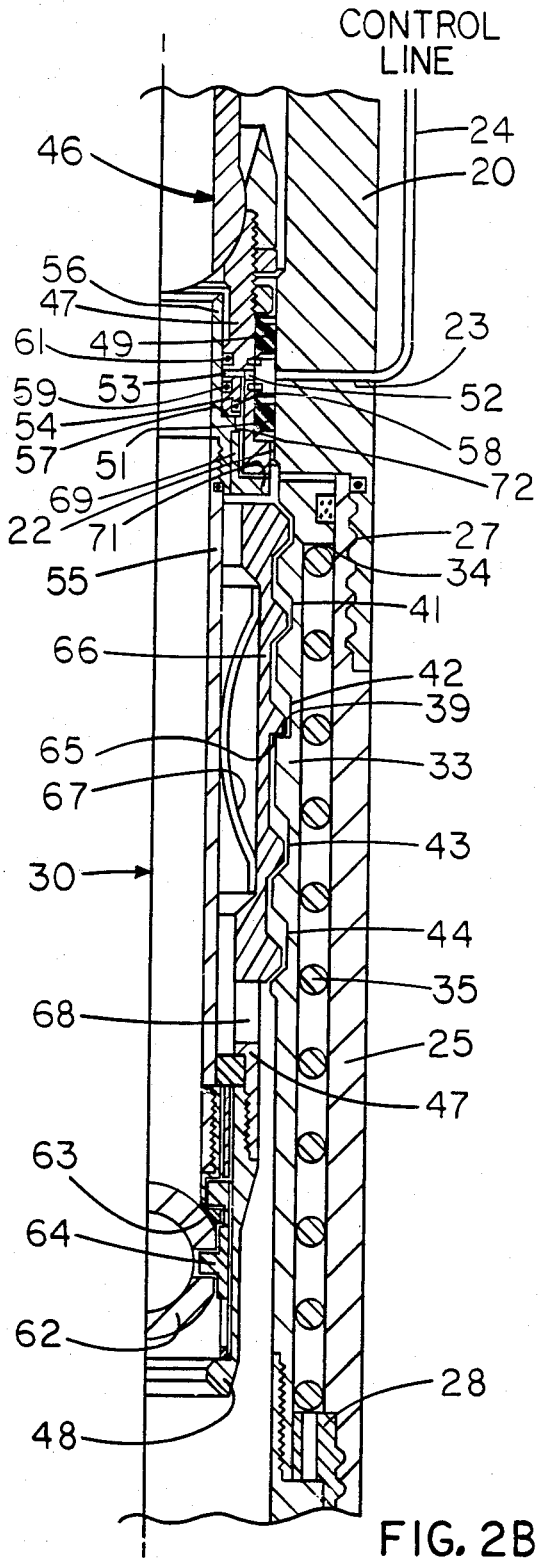
Figure 2C:
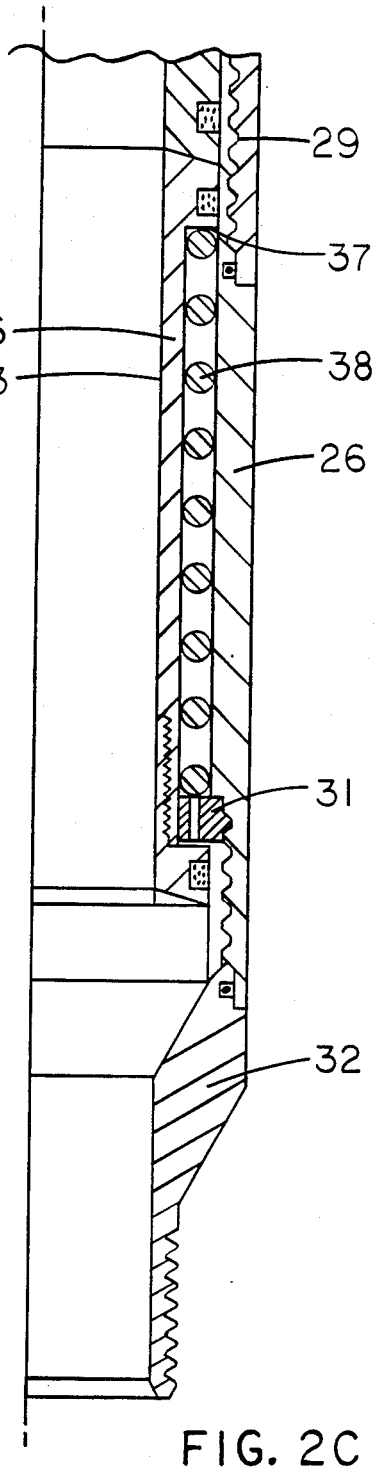

In the drawings wherein like reference numerals indicate like parts and wherein an illustrative embodiment of this invention is shown:

FIG. 1 is a schematic illustration of a well completed to utilize this invention; and FIGS. 2A, 2B and 2C are continuation quarter-section views of a landing nipple having therein a tool train shown partly in quarter-section and partly in elevation which includes the retrievable portion of the subsurface safety valve and the means for latching the valve in the nipple.

Referring first to FIG. 1, there is shown schematically a well 10 having tubing strings 11 and 12 therein. The strings are connected at their lower end by a conventional H-member 13. The string 11 is provided with a special landing nipple 14 which is adapted to receive a special subsurface safety valve in accordance with this invention.

Referring to FIGS. 2A, 2B and 2C, the landing nipple, indicated generally at 14, includes groove means for receiving and latching a tool string in the nipple.

The groove means may take any desired form to cooperate with the type of latch employed with the tool train. In the illustrated embodiment the tool train is designed to include separate locator and lock means and for this purpose the nipple 14 is provided with a locking groove 15 and a plurality of associated grooves 16, 17, 18, 19 and 21 for cooperating with a selector key, as will be understood by those skilled in the art.

Within the nipple a smooth bore 22 for co-acting with seals is provided and a port 23 extends through the nipple and communicates with a control line 24 extending to the surface in the conventional manner.

Below the smooth bore compression spring means are supported in the nipple on upwardly facing shoulder means. As illustrated, a plurality of springs and supporting shoulders may be utilized and as many springs may be stacked as desired, depending upon the depth at which the nipple is located to offset the weight of the hydrostatic head of fluid within the control line 24.

The nipple has first and second lower identical spring housings 25 and 26. The housing 25 is secured to the upper nipple housing section 20 by the thread system 27. At the lower end of the housing 25 a spring support means 28 is provided. In like manner the lower spring housing 26 is secured in the upper spring housing 25 by the thread system 29 and a spring support 31 is provided in the lower portion of the spring housing 26. The lower sub 32 is secured to the lower housing 26 and provides for securing the nipple in a tubing string in the conventional manner.

A tubular spring guide 33 is provided within the spring means and has a downwardly facing shoulder means 34 engaging the compression spring 35 which is supported on the spring support 28. Where a multiplicity of spring systems are used, the spring guide has a lower extension 36 having a downwardly facing shoulder 37 which engages the lower spring 38. Thus, the multiple springs when compressed provide an upward force which may be utilized to urge a subsurface safety valve to closed position, as will appear hereinbelow.

The spring guide 33 has an upwardly facing shoulder 39 for engagement with the valve operator and preferably the shoulder 39 is a part of a selector key system provided by grooves 41, 42, 43 and 44. These grooves may be utilized in the customary manner to accept only a single selector key, as will be understood by those skilled in the art.

A tool string made up of a lock indicated generally at 40, a selector key assembly indicated generally at 50, and a subsurface safety valve indicated generally at 30 may be run into and removed from the well in the conventional manner. There is shown a pumpdown type of train, but it will be appreciated that the train could be run on wireline, if desired.

The lock 40 may be provided by a K-lock and the selector key system 50 may be provided by the select twenty system, both obtainable from Otis Engineering Corporation of Dallas, Tex., and illustrated in Otis Catalogs OEC5113A and OEC5113B.

When the train is run in the hole by a locomotive, not shown, the select twenty key 60 will engage with the set of grooves 16 through 21 and will arrest further downward movement of the train. At such time the K-lock 40 will have its lug 45 extended to engage in groove 15 and latch the train in place. Latching of the train in the nipple 15 releases the locomotive which may be reversed out of the hole.

Dependent from the select key assembly 50 through the knuckle joint, indicated generally at 46, is the subsurface safety valve 30.

The safety valve 30 includes a housing provided by the top sub 47 and the lower sub 48.

Seal means 49 and 51 are carried on the exterior of the top sub 47 and cooperate with the smooth bore 22 in the landing nipple to straddle the landing nipple port 23 and seal between the housing and nipple.

The housing has a port 52 extending through the upper sub 47 and in fluid communication with the nipple port 23 to pressurize the chamber 53.

Slidable within the upper housing sub 47 is the piston 54 which surrounds the valve actuator provided by the tubular member 55 and its upper actuator extension 56. The piston 54 bears against the upwardly facing shoulder 57 on the actuator extension 56. The piston has a sliding seal with the upper sub 47 provided by O-ring 58 and a sliding seal with the actuator extension 56 provided by O-ring 59. The chamber 53 is completed by the O-ring 61 which provides a sliding seal between the upper sub 47 and the actuator extension 56.

The actuator is cooperable with the piston 54 and is movable downwardly by the piston to move the valve member 62 to its open position.

The valve member 62 is conventional in form and cooperates with the valve seat 63 to control flow through the valve. The valve 62 is rotated by the finger means 64 which is carried on the lower end of the actuator tube 55.

The actuator is provided with a downwardly facing shoulder 65 which engages the upwardly facing shoulder 39 on the spring guide 33 and compresses the two springs 35 and 38 with downward movement of the valve actuator 55. Preferably, the shoulder 65 is carried by a selector key 66 urged outwardly by spring 67 in the conventional manner. The key 66 resides in a slot 68 in valve housing 47 and is reciprocal vertically therein. The key 66 has the customary ears spaced circumferentially to either side of the slot 68 and engaging the housing 47 to limit outward movement of the keys to the position shown in the conventional manner.

The actuator 55 is threadedly connected to actuator extension 56 which carries an external annular sleeve 69. Flange 72 on actuator extension 56 transmits force through external sleeve 69 and flange 71 into the upper end of key 66 and thence through the key to the shoulder 39 on the spring guide 33 to compress the spring with downward movement of the actuator.

In operation the tool string is run into the landing nipple 14 until the select twenty, key 60 engages in the landing nipple, as shown. Thereafter manipulation of the locomotive will extend locking lug 45 of the K-lock and release the locomotive for removal from the well. Preferably, during this latching manipulation the spring guide 33 will have been engaged and with the locking lug 45 extended the springs 35 and 38 are under slight compression.

When it is desired to open the subsurface safety valve, the control line 24 is pressurized to pressurize chamber 53 and drive piston 54 downwardly. This in turn exerts a downward force through the upper actuator section 56, the shoulder 71, and key 66 onto the spring guide 33. This downward force will move the spring guide 33 downwardly to compress the two springs 35 and 38 while the actuator 55 is rotating the valve member 62 to its open position.

If at any time pressure within the control line 24 is relieved, the spring means provided by the two springs 35 and 38 will drive the actuator 55 upwardly to move the valve member 62 to the closed position, as shown.

In accordance with conventional practice where a floating piston, such as piston 54, is utilized, the valve may be pumped through by pumping fluid into the upper end of the tubing to force the valve 62 to open. Due to the sliding engagement between the piston 54 and the actuator section 56 the actuator can move downwardly leaving the piston in its upper position, as shown, to permit pumping by the valve.

If at any time a seal fails and interferes with proper function of the subsurface safety valve, it may be retrieved in the conventional manner and such seal replaced and the train rerun to re-install the subsurface safety valve in the well, as all of the seals employed in the assembly are carried on the retrievable subsurface safety valve.

The bore through the actuator 55 and through the valve member 62 may be substantially larger than in conventional design of retrievable subsurface safety valves as the springs 35 and 38 are not a part of the retrievable structure and are carried in the nipple which may have a slightly enlarged diameter to accommodate these springs, resulting in a flowway through the nipple which while including the springs is large enough to provide a full open bore 73 through the nipple which may be equal in size to the flowway through the tubing above and below the nipple. Thus, the restriction in the flowway provided by the subsurface safety valve is defined by the actuator 55 which may be substantially larger than conventional design, as the springs 35 and 38 form no part of the retrievable valve.

From the above it will be seen that by separating the spring system from the remainder of the subsurface safety valve and by providing all of the seals on the retrievable portion of the subsurface safety valve that a large flowway through the retrievable subsurface safety valve may be provided while at the same time permitting all of the seals to be carried on the valve which may be removed and redressed in the event of failure of the seal.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. Apparatus comprising:

a landing nipple including;

groove means in said nipple for receiving and latching a tool string in the nipple, compression spring means supported in the nipple on upwardly facing shoulder means, a spring guide within the spring means having downwardly facing shoulder means engaging said spring means, said spring guide being tubular and having an upwardly facing shoulder for abutment with an actuator, and a port in said nipple for introducing control fluid into the nipple bore; and a separately removable tool string within said nipple including:

a releasable latch cooperable with said nipple groove means for latching the tool string to the nipple; and a subsurface safety valve comprising;

a housing having exterior seal means straddling said nipple port with a seal above and a seal below said port when the string is landed, a port in said housing communicating with said nipple port, a piston in said housing exposed to said housing port, an actuator cooperable with and movable downwardly by said piston, a valve seat and cooperable valve member movable between open and closed positions by reciprocation of said actuator, and downwardly facing shoulder means on said actuator and engageable with said spring guide shoulder to compress said spring means in response to pressure against said piston to move said valve member to open position.

2. The apparatus of claim 1 wherein said spring means is provided by a plurality of stacked springs.

3. The apparatus of claim 1 wherein the downwardly facing shoulder on the actuator is provided by a selector key resiliently urged outwardly to engage said spring guide shoulder.

4. The apparatus of claim 1 wherein said spring means is provided by a plurality of stacked springs, and the downwardly facing shoulder on the actuator is provided by a selector key resiliently urged outwardly to engage said spring guide shoulder.

5. The apparatus of claim 1 wherein said releasable latch and said downwardly facing shoulder on the actuator include selector keys.

6. The apparatus of claim 1 wherein said spring means is provided by a plurality of stacked springs, and said releasable latch and said downwardly facing shoulder on the actuator include selector keys.

* * * * *